United States Patent [19]

Lowe

[11] Patent Number: 4,503,646

[45] Date of Patent: Mar. 12, 1985

[54] BULK STORAGE BUILDING STRUCTURE

[76] Inventor: Henry E. Lowe, 201 N. Edwards St., Cassopolis, Mich. 49031

[21] Appl. No.: 499,303

[22] Filed: May 31, 1983

[51] Int. Cl.[3] ..... E04H 7/34

[52] U.S. Cl. ..... 52/198; 52/248; 52/473; 52/663

[58] Field of Search ..... 52/192–198, 52/248, 473, 663, 667; 119/58, 60

[56] References Cited

U.S. PATENT DOCUMENTS

| | | | |
|---|---|---|---|
| 710,857 | 10/1902 | Griesser | 52/473 |
| 1,030,406 | 6/1912 | Hubbard . | |
| 1,225,576 | 8/1917 | Campbell . | |
| 1,360,408 | 11/1920 | Johnson | 52/248 |
| 1,699,162 | 1/1929 | Santos . | |
| 2,124,430 | 7/1938 | Phillips . | |
| 3,144,881 | 8/1964 | Sproul | 52/663 |
| 3,176,432 | 4/1965 | Doolittle . | |

FOREIGN PATENT DOCUMENTS

| | | | |
|---|---|---|---|
| 216011 | 7/1958 | Australia | 52/198 |
| 161002 | 4/1921 | United Kingdom | 52/663 |
| 768530 | 2/1957 | United Kingdom | 52/198 |

*Primary Examiner*—James L. Ridgill, Jr.
*Attorney, Agent, or Firm*—Marmaduke A. Hobbs

[57] ABSTRACT

A bulk storage building structure for storing grain, dried clay and other granular products in which the normally encountered lateral pressure exerted on the walls of the structure is minimized by the spaced, slatted configuration of the walls which accommodates the angle of repose of the stored material. This configuration effectively increases the total available surface area of the structure such that the structure may be made as large as is necessary of practicable without the expensive wall reinforcements required for conventional storage structures.

13 Claims, 10 Drawing Figures

Fig. 7
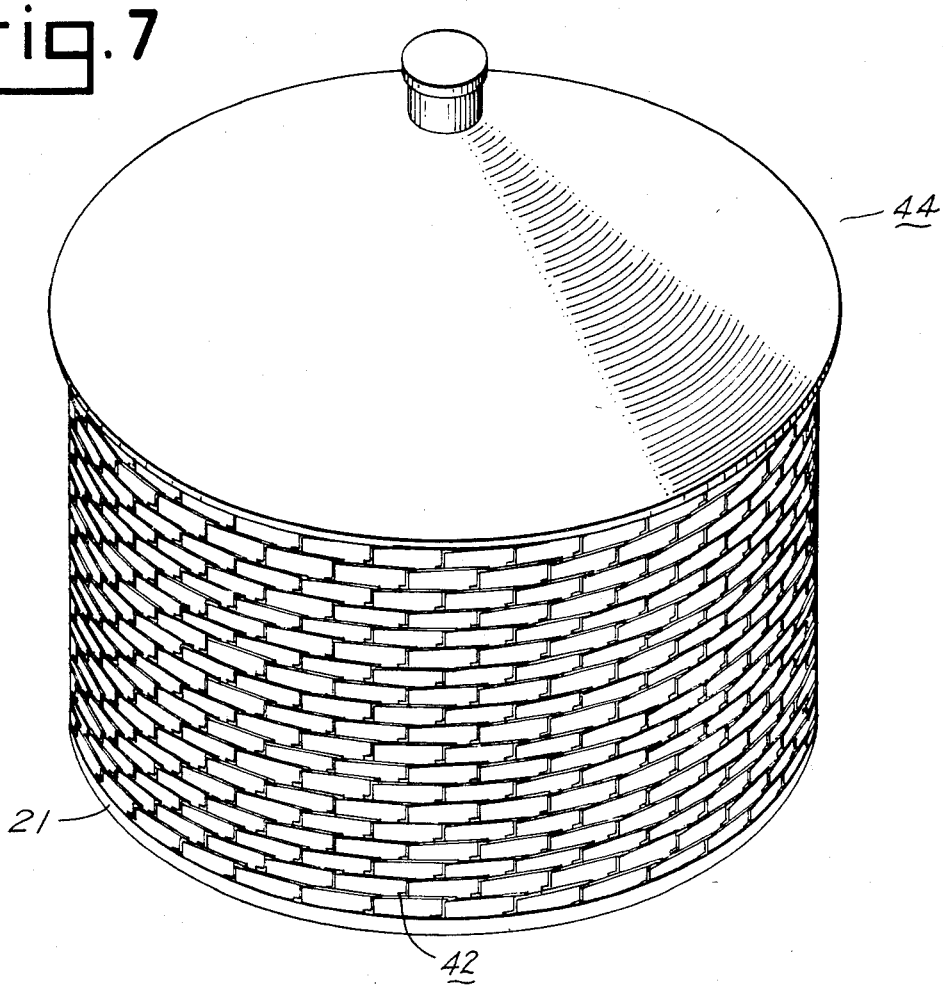
Fig. 8
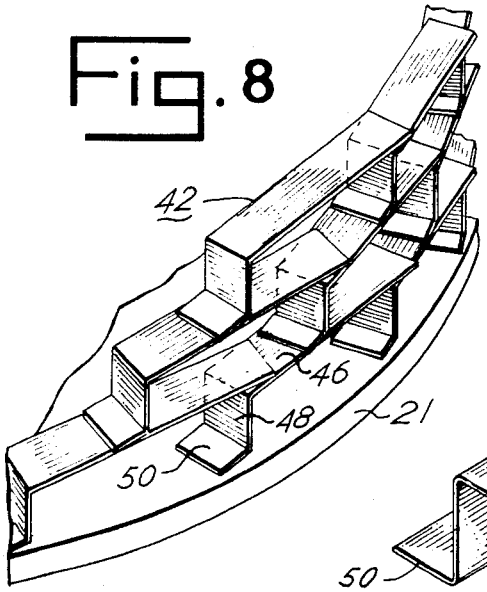
Fig. 10
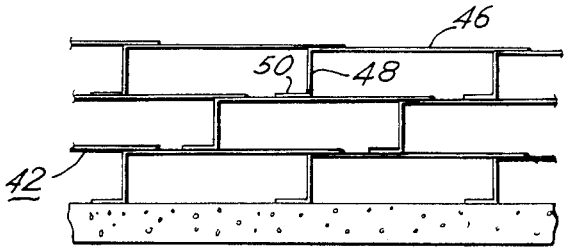
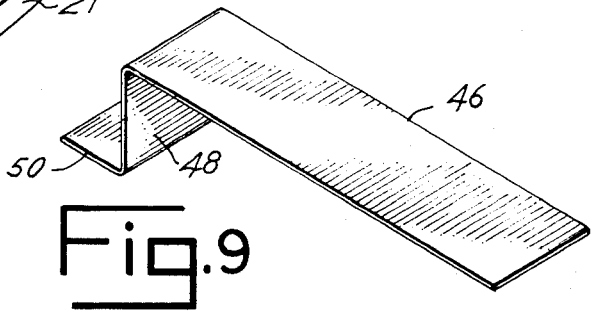
Fig. 9

BULK STORAGE BUILDING STRUCTURE

BACKGROUND OF THE INVENTION

Many materials and products are produced most efficiently in large quantities or, in the case of farm grain products, must be produced all at once due to environmental factors. In order to realize some of the benefits of efficient production, these materials must be conveniently and inexpensively stored until they are needed. The current practice involves the use of bulk storage buildings; however, there are several significant drawbacks to these buildings. Generally speaking, the larger the storage building, the more cost-efficient it becomes; however, a major problem involves the tremendous downward and lateral pressures exerted on the walls of the storage building by the materials placed inside. When a semi-fluid material such as clay particles or grain is poured into a storage facility from the top, or even when poured on the ground, it forms a cone, with the angle between the sides of the cone and the base forming the angle of repose of the material. This configuration, with the weight concentrated at the bottom and sides of the cone, along with the friction exerted downwardly on the wall of the building by the material inside, accounts for the high pressures. For example, a circular storage building of relatively modest size having a diameter of 16 feet and a height of 20 feet will hold approximately 3220 bushels of small-particle grain. This quantity exerts forces on the side walls of 2000 pounds downward pressure per lineal foot and 400 pounds lateral pressure per square foot. Similar values are obtained for other small-particle products such as dried clay. Since building sizes may extend to capacities over 10,000 bushels, the pressures exerted on the building are of primary concern. Reinforcement measures taken to insure the integrity of the structures add substantially to their costs, requiring users to strike a balance between storage capacity needed and the cost of a structure which is able to withstand the large pressures involved.

One of the main reasons for having storage facilities is to keep the stored materials out of the weather; however, ventilation is desirable to prevent spoilage or to effect further drying once the material is stored. For example, dried clay is used in many instances as an absorbent and its chief economic value lies in the dryness of the material; thus, shelter is essential. Most grains must be dried before storage to an approximate moisture content ranging from 12% to 14% lest spoilage occur, and once the products have been dried, often using expensive drying equipment, they must be kept dry to avoid losses from spoilage, from having to sell damp grain with its concomitant lower price, or from having to re-dry the materials. However, slight declines in moisture content are acceptable in many cases, and since spoilage can occur where the grain has not been dried to its optimum moisture content, ventilation is normally desired; thus, the structure must serve both interests.

Bulk storage also confers benefits on users where a large quantity of material must be stored in order to maintain adequate supplies for use over a period of time, as with road salt and sand stored for use over the winter. Fewer deliveries and fewer storage facilities translate into greatly reduced costs, thus freeing funds for purchase of additional stored materials instead of for additional storage facilities, more deliveries, and/or reinforcement of existing structures.

SUMMARY OF THE INVENTION

It is, therefore, one of the principal objects of this invention to provide a bulk storage building structure which has been designed to minimize the lateral pressure exerted on the walls of the structure by the material placed inside so that the structure can be made as large as is necessary or practicable without requiring expensive reinforcement of the walls, and which is extensively ventilated to prevent spoilage from trapped moisture while providing for maximum usage of the available area within the structure.

Another object of the invention is to provide a bulk storage building structure in which the side walls have been designed and can be adjusted to accommodate the angle of repose of the particular material to be stored within the structure, thus spreading the weight distribution of the material over a much larger area than possible with conventional structures while protecting the material from the elements.

These and other objects are attained in the present invention which relates to a bulk storage building structure with vertical frame members preferably having a plurality of slots for receiving horizontal wall members. The wall members, when inserted into the slots, form a spaced, slatted arrangement with the generally flat wide surface of the wall members disposed substantially perpendicular to the vertical frame members. The spacing between the wall members is adjustable by adding or removing slats to correspond to the angle of repose of the material to be stored. As noted above, semi-fluid materials of the type normally stored in buildings of this type form a cone when poured into the buildings, and the angle of repose of the material is the angle formed where the side of the cone contacts the base. Every semi-fluid material has a distinct angle of repose which is affected by various surface tension factors such as roughness or smoothness, particle size and shape, weight, density, and whether the material is wet or dry. Generally speaking, the angle of repose will be greater when there is less surface tension between the particles. Clay particles, of the size and shape used for cat litter, for example, have an angle of repose of approximately 33°. Sand, having less surface tension, has a somewhat shallower angle of repose, while rock salt or gravel, having more surface tension, due to the rough, angular surfaces, has a steeper angle of repose.

If the building of the present invention is to be used for storing clay particles and the angle of repose is known to be approximately 33°, the slats in the building are arranged so that a line drawn from near the outside edge of a slat to the inside edge of the slat immediately above has a slope of approximately 33°. The clay, when poured into the building, flows into the area between the slats extending from near the outside edge of a particular slat to the inside edge of the slat immediately above along the line corresponding to the angle of repose. The areas between the slats fill in this manner, resulting in almost total negation of the lateral pressures normally exerted against the walls. The downward force on the walls becomes mainly a function of the weight of the material alone, since most of the lateral pressure or force is exerted only against the edges of the slats, although there are relatively minor downward frictional forces on the inside edges of the slats and lateral frictional forces on the upper sides of the slats.

The weight distribution is spread over a much larger surface area than is possible with a conventional storage building, and the present invention can be made substantially larger than the conventional storage bins without the expense of reinforcing the walls to withstand the pressures which normally occur in the conventional structures.

Additional objects and advantages of the bulk storage building structure embodying the present invention will become apparent from the description below with reference to the accompanying drawings.

BRIEF DESCRIPTION OF THE DRAWINGS

FIG. 7 is a perspective view of a circular bulk storage building structure illustrating a further embodiment of the present invention, using the same basic concept with a different building material;

FIG. 8 is a fragmentary perspective view of a wall of the bulk storage building structure shown in FIG. 7;

FIG. 9 is a perspective view of a wall component used in the bulk storage building structure shown in FIG. 7; and FIG. 10 is a fragmentary side elevational view of a wall of a bulk storage building structure illustrating a rectangular embodiment.

DETAILED DESCRIPTION OF THE PREFERRED EMBODIMENT

Figure 1:
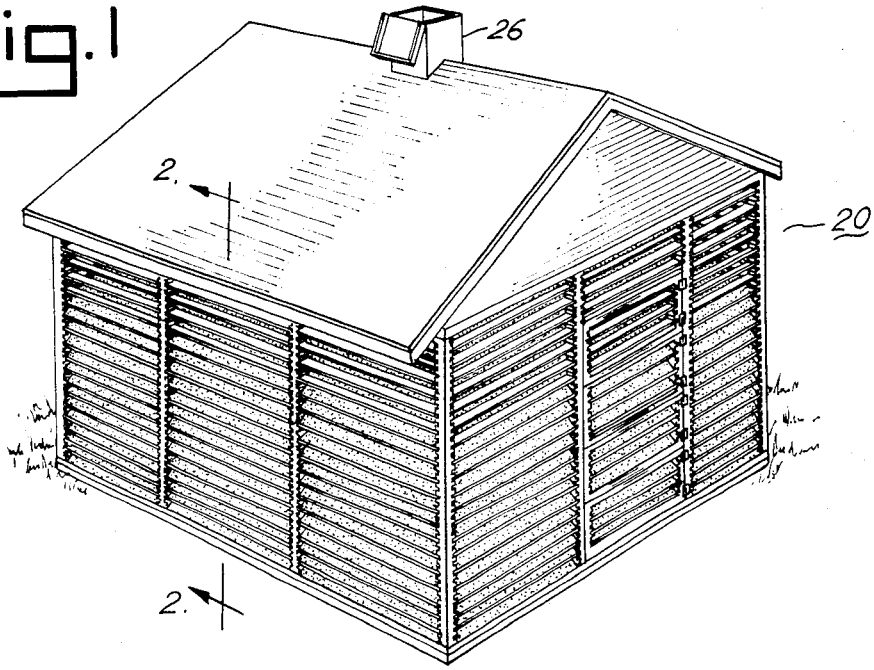
FIG. 1 is a perspective view of a rectangular bulk storage building structure, illustrating one embodiment of the present invention.

Referring more specifically to the drawings, and to FIG. 1 in particular, numeral 20 indicates generally a rectangular bulk storage building structure, illustrating one embodiment of the present invention, having a base 21 and a series of spaced vertical frame members supported by the base and preferably having a plurality of slots into which are inserted horizontal wall members. The wall members are preferably thin boards such as 2×8's, or thin metal members, and present the generally flat, wide surface substantially perpendicular to the vertical frame members. The building embodying the present invention may be rectangular, circular, or even triangular in shape, each embodiment having horizontal wall members in a spaced, slatted arrangement, the spacing between the slats accommodating the angle of repose of the material to be stored. The buildings are normally constructed of wood or metal and can be built to any size needed for a particular application without requiring expensive reinforcement measures to ensure the integrity of the structure against the substantial downward and lateral pressures which would be exerted on the structure by the stored material, due to the slatted arrangement of the wall members. The present invention has also been designed such that manufacture of the components can be standardized; thus, the structure may be provided in kit and/or modular forms.

Figure 2:
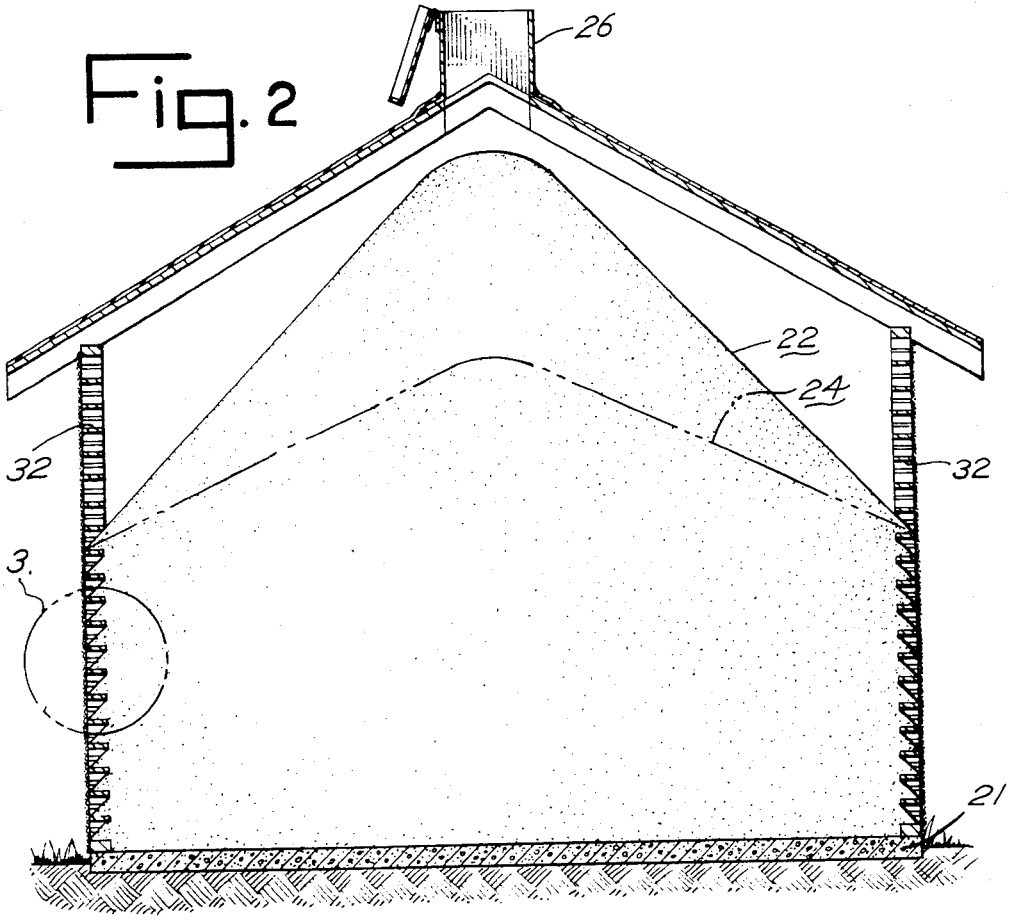
FIG. 2 is a cross-sectional view of the bulk storage building structure shown in the preceding figure, the section being taken on line 2—2 of FIG. 1, the broken line and the solid line illustrating the positions of materials having different angles of repose.

In FIG. 2, the solid line designated by numeral 22 represents a material having one angle of repose, while the broken line 24 represents a different material having another angle of repose. The materials are normally introduced into the structure through a roof portal 26, and being semi-fluid materials, they form a cone having a distinct angle of repose, dependent upon various surface tension factors. The material represented by numeral 22 has a greater or steeper angle of repose than material 24, due to greater surface tension factors such as particle size and shape, surface configuration, weight, and moisture content.

Figure 3:
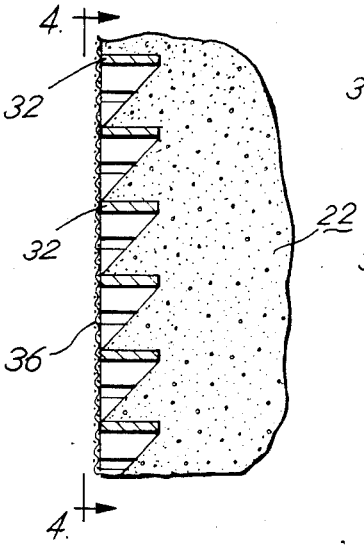
FIG. 3 is an enlarged, fragmentary cross-sectional view of a wall of the bulk storage building structure, the section taken from the area designated by numeral 3 of FIG. 2, illustrating the angle of repose of the stored material designated by the solid line.
Figure 4:
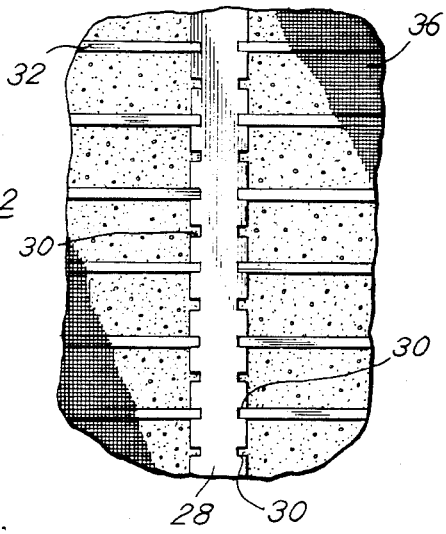
FIG. 4 is an enlarged fragmentary side elevational view of a wall of the bulk storage building structure shown in the preceding figures, the view being taken on line 4—4 of FIG. 3.
Figure 5:
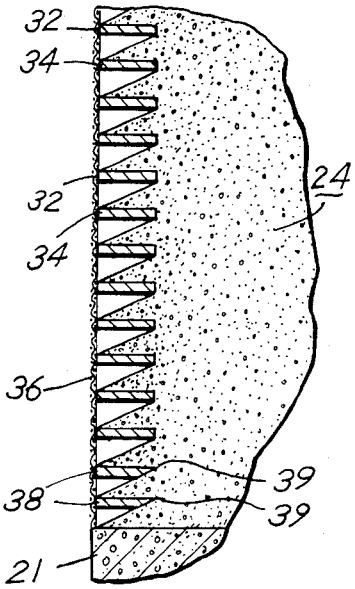
FIG. 5 is an enlarged fragmentary cross-sectional view of a wall of the bulk storage building structure similar to that shown in the preceding figures, the section being taken from the area designated by numeral 3 of FIG. 2, illustrating the angle of repose of the stored material designated by the broken line in FIG. 2.
Figure 6:
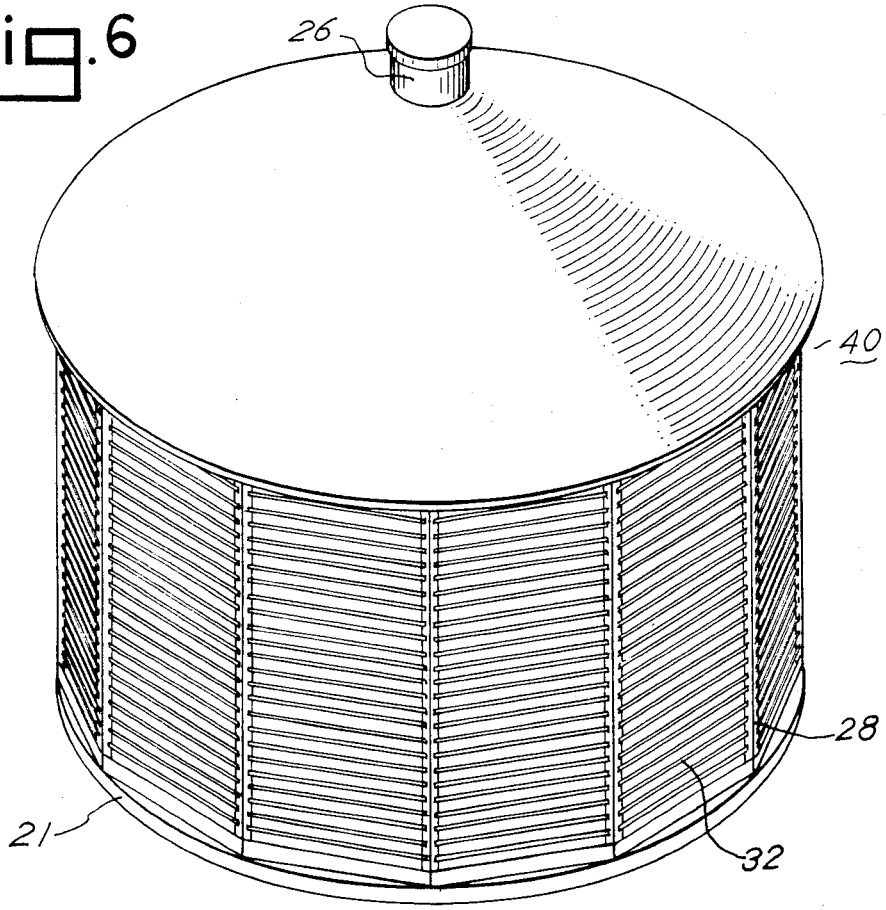
FIG. 6 is a perspective view of a circular bulk storage building structure, illustrating another embodiment of the present invention.

The enlarged views of FIGS. 3 through 5 clearly show the configuration of the walls of this embodiment. Vertical frame member 28 has a plurality of vertically spaced slots 30 cut in both sides thereof and disposed directly opposite one another. These particular vertical members have been designed for a position along a side wall of a rectangular structure. The vertical members for the corners will be shaped differently, but will have a similar slotted configuration, while vertical members used in a circular embodiment 40, shown in FIG. 6, will be substantially identical to one another, also having a similar slotted configuration. Horizontal wall members 32 are disposed in the slots and extend from one vertical member to the succeeding vertical member. The view in FIG. 3 shows the spacing between the slats which is used for material 22 of FIG. 2, and the view in FIG. 5 shows the spacing used for material 24 of FIG. 2. Since material 24 has a shallower angle of repose, additional slats 34 are used to accommodate this angle. Where the bulk storage building is used to store grain products, a screen 36 can be provided to prevent pests from reaching the grain. The angle of repose should be determined before the building is filled, either from experience, empirical data, or from as simple a test as pouring a small amount of the material on a flat surface and measuring the angle of the side of the cone formed. With the angle determined, the spacing of the slats required can be adjusted to accommodate this angle by measuring the slope of a line extending from the outside edge of a slat to the inside edge of the slat immediately above and placing the slats accordingly. The stored material fills most of the area between the slats along the line corresponding to the angle of repose, thereby substantially negating the lateral pressure and the frictional downward pressure exerted on the walls by the material inside. The lateral pressure component and the downward frictional pressure component can be reduced even further by beveling the inside edges of the slats, reducing the surface area of the retaining walls even further, as shown by wall members 38 in FIG. 5 with beveled edges 39.

FIGS. 7 through 10 disclose a further embodiment of the present invention, using a plurality of structural members or elements 42, preferably of metal, for facilitating fabrication and providing the required strength in building 44. The basic concept remains the same in this embodiment, the structural members presenting substantially flat, horizontal surfaces, generally parallel to the base, for receiving and supporting stored material and accommodating the angle of repose, thereby substantially negating the inherent lateral pressure and the downward frictional pressures, the thin metal edges of this embodiment being similar to the beveled edges 39 shown in FIG. 5. The structural members or elements 42 have a main horizontal portion 46, a vertical portion 48 and a base portion 50, the members being assembled in an overlapping, staggered configuration as shown in FIG. 8 for a circular embodiment and in FIG. 10 for a rectangular embodiment. The individual members may then be bolted, riveted or otherwise fastened together as the structure is assembled.

In the use and operation of the present invention, the bulk storage building structure may be constructed so that the wall members 32 and 34 are removable to permit the structure to accommodate different materials having different angles of repose, or it may be constructed in a permanent configuration for accommodating a single material or materials having substantially the same angle of repose. The spaced slatted arrangement of the side walls results in a substantial reduction or negation of both lateral and downward pressures exerted on these walls by the material inside the structure; thus, the structure can be built as large as is necessary or practicable without requiring expensive reinforcement of the walls. Once the structure has been completed, the angle of repose of the material to be stored has been determined, and the spacing of the side walls has been adjusted to accommodate this angle, material may be added, normally through a center roof portal, the material forming a cone inside the structure. The material forming the sides of this cone flows into the spaces between the wall slats, extending from near the outer edge of a particular slat to the inner edge of the slat immediately above, assuming a position corresponding to the particular angle of repose. As noted, this configuration may be altered for storing different materials; however, the almost total negation of the lateral pressures is accomplished in all of the embodiments disclosed herein.

While several embodiments of a bulk storage building structure have been disclosed and described in detail herein, various changes and modifications may be made without departing from the scope of the invention.

I claim:

1. A bulk storage building structure mounted on a base and having a filler portal near the top, comprising a plurality of generally vertical frame members extending upwardly from said base and spaced apart at predetermined intervals, and a plurality of slat-like wall members disposed substantially horizontally in both the radial and peripheral directions in the building structure and having relatively broad, substantially flat upper surfaces for supporting stored materials, said wall members being connected to said vertical members and spaced apart at substantially regular intervals, the vertical spacing between said wall members being determined by the angle of repose of the materials to be stored in said structure such that the plane of the upper surface formed by the bulk materials on the angle of repose between two adjacent wall members intersects said upper surface inwardly from the outer edge thereof.

2. A bulk storage building structure as defined in claim 1 in which said vertical members have a plurality of vertically aligned generally horizontal slot spaced apart at substantially regular intervals and disposed opposite one another on both sides of said vertical member for receiving said wall members.

3. A bulk storage building structure as defined in claim 2 in which said upper surfaces are disposed substantially perpendicular to said frame members.

4. A bulk storage building structure as defined in claim 3 in which said wall members have downwardly and outwardly extending beveled inner edges disposed at an angle substantially the same as the angle of repose of the stored materials.

5. A bulk storage building structure mounted on a base and having a roof and a center portal for filling said structure, the improvement comprising, a plurality of slat-like wall members, each of said members having a generally flat, relatively broad upper surface and being disposed substantially horizontally in both the radial and peripheral directions in the building structure, and the relationship between the vertical spacing and radial widths of said wall members being determined by the angle of repose of the materials to be stored in said structure such that the plane of the upper surface formed by the bulk materials on the angle of repose between two adjacent wall members intersects said upper surface.

6. A bulk storage building structure as defined in claim 5 in which there are a plurality of generally vertical frame members extending upwardly from said base and spaced apart at predetermined intervals.

7. A bulk storage building structure as defined in claim 6 in which said frame members have a plurality of vertically aligned slots therein for receiving said wall members and said slots are disposed opposite one another on both sides of said vertical members.

8. A bulk storage building structure as defined in claim 7 in which said wall members have downwardly and outwardly extending beveled inner edges disposed at an angle substantially the same as the angle of repose of the stored material.

9. A bulk storage building structure as defined in claim 5 in which said wall members consist of a plurality of structural elements each having a generally vertical portion, a horizontal base portion extending in one direction from the bottom of said vertical portion and a generally horizontal portion extending in the opposite direction from the top of said vertical portion, and a means securing said structural members together to form the walls of said building structure.

10. A bulk storage building structure as defined in claim 9 in which said horizontal portions are disposed generally parallel to said base portion for receiving a stored material.

11. A bulk storage building structure as defined in claim 10 in which said structural elements are disposed in an overlapping, staggered configuration.

12. A bulk storage building structure as defined in claim 11 in which said horizontal portions are spaced apart at substantially regular intervals.

13. A bulk storage building structure as defined in claim 12 in which said horizontal portions are spaced apart at predetermined intervals for accommodating a predetermined angle of repose of a material to be stored therein.

* * * * *